US010900242B2

(12) United States Patent
Valentine

(10) Patent No.: US 10,900,242 B2
(45) Date of Patent: Jan. 26, 2021

(54) COATED BASEBOARD FOR SPORTS FLOOR

(71) Applicant: Jim Louis Valentine, Glencoe, OK (US)

(72) Inventor: Jim Louis Valentine, Glencoe, OK (US)

( * ) Notice: Subject to any disclaimer, the term of this patent is extended or adjusted under 35 U.S.C. 154(b) by 0 days.

(21) Appl. No.: 16/391,586

(22) Filed: Apr. 23, 2019

(65) Prior Publication Data

US 2020/0340257 A1 Oct. 29, 2020

(51) Int. Cl.
*E04F 19/04* (2006.01)

(52) U.S. Cl.
CPC .... *E04F 19/049* (2013.01); *E04F 2019/0422* (2013.01); *E04F 2019/0445* (2013.01)

(58) Field of Classification Search
CPC ..... E04F 19/049; E04F 2019/0422; E04F 2019/0445
USPC ..... 52/287.1, 288.1, 290, 302.3
See application file for complete search history.

(56) References Cited

U.S. PATENT DOCUMENTS 3,273,296 A * 9/1966 Soulon ..... E04F 19/045 52/288.1
3,453,171 A * 7/1969 Crowley ..... C08J 9/06 428/159
4,292,354 A * 9/1981 Katoh ..... B32B 15/08 428/31
4,350,739 A * 9/1982 Mohiuddin ..... B29C 37/0032 264/250
4,812,336 A * 3/1989 Okamoto ..... B05D 5/06 427/257
5,643,669 A * 7/1997 Tsuei ..... B24D 3/28 428/354
5,934,034 A * 8/1999 Yahiro ..... E04F 13/06 52/255
6,101,775 A * 8/2000 Larimore ..... E04F 15/02405 454/247
6,593,417 B1 * 7/2003 Anderson ..... B82Y 30/00 524/588
6,759,478 B2 * 7/2004 Anderson ..... B82Y 30/00 524/588

(Continued)

FOREIGN PATENT DOCUMENTS

JP 62001478 A * 1/1987
JP 10238093 A * 9/1998

(Continued)

OTHER PUBLICATIONS

Machine Tanslation of JP-62001478-A (Year: 2020).*

*Primary Examiner* — Brent W Herring
(74) *Attorney, Agent, or Firm* — Dunlap Codding, P.C.

(57) ABSTRACT

A baseboard for covering an expansion gap at an intersection of a vertical wall and a floor. The baseboard includes a substantially L-shaped body formed of a thermoplastic material and having a toe portion and a wall portion. The toe portion has a front side and a back side, and the wall portion has a front side, a back side, an upper end, and a lower end. The back side of the wall portion is provided with a plurality of spaced-apart ventilation channels extending entirely across the wall portion from the upper end of the wall portion to the lower end thereof to permit air-flow to and from the floor gap. At least the front side of the toe portion and the front side of the wall portion is coated with a flexible coating.

8 Claims, 3 Drawing Sheets

(56) References Cited

U.S. PATENT DOCUMENTS

| | | | | |
|---|---|---|---|---|
| 7,516,584 | B2 * | 4/2009 | Valentine | E04F 19/04 52/287.1 |
| 8,519,052 | B2 * | 8/2013 | Okamoto | C08L 55/02 525/166 |
| 2004/0006944 | A1 * | 1/2004 | Miyamoto | E04F 15/14 52/506.01 |
| 2005/0011159 | A1 * | 1/2005 | Standal | B28B 1/14 52/716.1 |
| 2006/0130413 | A1 * | 6/2006 | Valentine | E04F 19/04 52/287.1 |
| 2007/0106008 | A1 * | 5/2007 | Onoue | C09D 7/68 524/493 |
| 2010/0022692 | A1 * | 1/2010 | Ikeda | C09K 3/10 524/114 |
| 2011/0226996 | A1 * | 9/2011 | Postma | C09D 5/22 252/301.36 |
| 2012/0279152 | A1 * | 11/2012 | Evans | E04F 19/045 52/287.1 |
| 2013/0116375 | A1 * | 5/2013 | Okamoto | C08L 55/02 524/513 |
| 2015/0004401 | A1 * | 1/2015 | Kojima | C09D 175/04 428/334 |
| 2015/0258571 | A1 * | 9/2015 | Lindsay | C09D 175/04 222/107 |
| 2016/0238274 | A1 * | 8/2016 | Marcil | F24F 13/084 |

FOREIGN PATENT DOCUMENTS

| | | | | |
|---|---|---|---|---|
| JP | 2009281118 | A | * | 12/2009 |
| JP | 2010048047 | A | * | 3/2010 |
| JP | 2011111854 | A | * | 6/2011 |
| JP | 2019138069 | A | * | 8/2019 |

* cited by examiner

COATED BASEBOARD FOR SPORTS FLOOR

BACKGROUND

Certain types of sports floors, such as found in a gymnasium, are constructed so the floor absorbs impact forces. The floors are often made of wood and supported above a concrete slab with a plurality of shock absorbers. The shock absorbers function as spacers creating a space between the floor and the concrete slab. While the space allows the floor to flex and absorb impact forces, the space is also an ideal location for moisture to collect. The moisture may then be absorbed by the wood floor and cause the floor to swell which can affect the performance of the floor and shorten its life. Therefore, it is desirable to ventilate the space between the floor and the concrete slab to eliminate the accumulation of moisture.

Baseboards for covering expansion gaps at the intersection of a vertical wall and a floor are well known. Many baseboards are designed to be adhered to the wall so as not to provide any ventilation between the baseboard and the wall. However, baseboard units have been suggested which have included grooves or slot along the backside of the baseboard for air circulation beneath the floor. While such baseboards have been met with success, depending on the method of manufacture, they nevertheless be expensive to manufacture and transport, and difficult to handle.

Vented baseboards have been formed into a one piece unit using conventional manufacturing processes, such as compression molding and injection molding. While compression molding produces a product of uniform color, compression molding is less efficient and thus costly than injection molding. During the injection molding process, the thermoplastic material may be heated within a temperature range of about 340° F. to about 360° F., which causes flow lines (not shown) to be created throughout the baseboard. The flow lines provide a marbled appearance, which is appealing to some users because the marbled appearance can hide evidence of mars. Other users prefer a more uniform outer appearance for the baseboard.

To this end, a need exists for a baseboard manufactured by injection molding and which has a uniform outward surface, while also providing adequate ventilation beneath a floor, being resistant to mars, and is lightweight. It is to such a baseboard that the inventive concepts disclosed herein are directed.

DETAILED DESCRIPTION OF EXEMPLARY EMBODIMENTS

Figure 1:
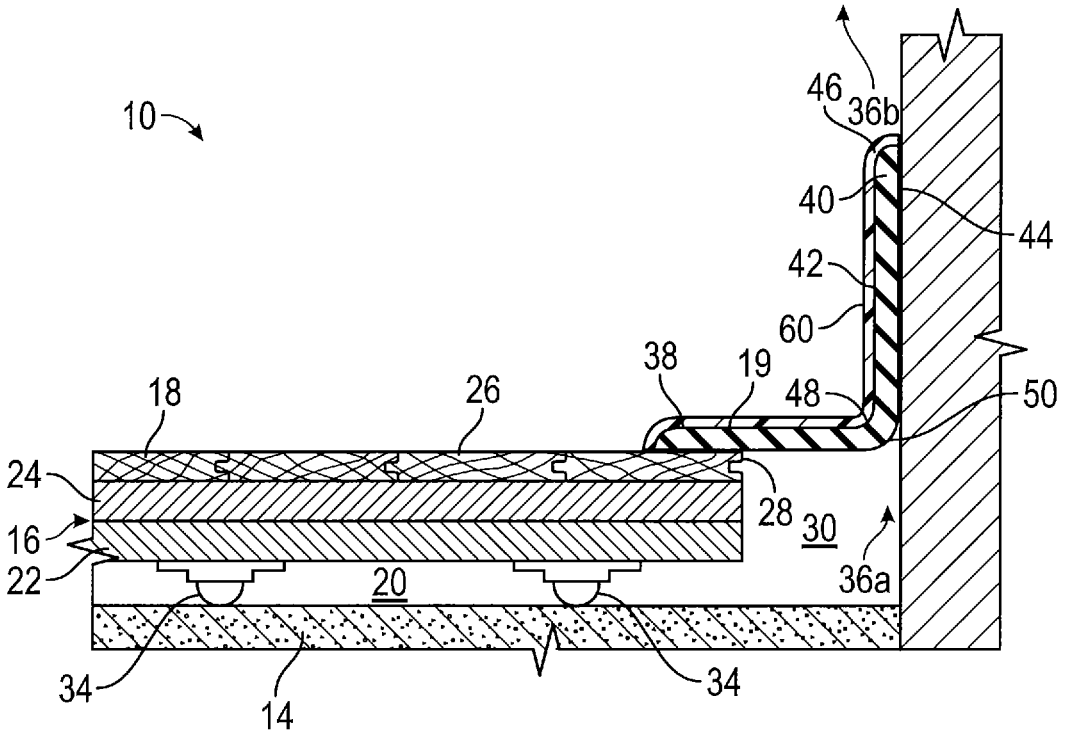
FIG. 1 is a perspective view of a baseboard constructed in accordance with the inventive concepts disclosed herein shown positioned over a portion of a floor and wall.

Before explaining at least one embodiment of the inventive concepts disclosed, it is to be understood that the inventive concepts are not limited in their application to the details of construction and the arrangement of the components or steps or methodologies in the following description or illustrated in the drawings. The inventive concepts disclosed are capable of other embodiments, or of being practiced or carried out in various ways. Also, it is to be understood that the phraseology and terminology employed is for description only and should not be regarded as limiting the inventive concepts disclosed and claimed herein.

In this detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features may not be described to avoid unnecessarily complicating the disclosure.

Further, unless stated to the contrary, "or" refers to an inclusive "or" and not to an exclusive "or." For example, a condition A or B is satisfied by anyone of: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts disclosed. This description should be read to include one or at least one and the singular also includes the plural unless it is obvious that it is meant otherwise.

As used herein any reference to "one embodiment" or "an embodiment" means that a particular element, feature, structure, or characteristic described in the embodiment is included in at least one embodiment. The appearances of the phrase "in one embodiment" in various places in the specification are not necessarily all referring to the same embodiment.

Figure 4:
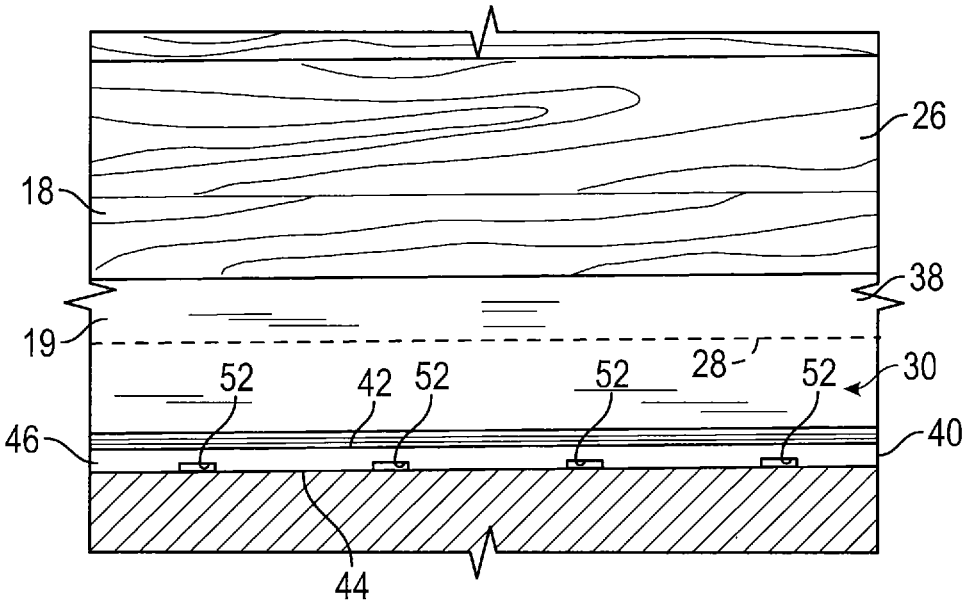
FIG. 4. is a top plan view of the baseboard shown positioned over a portion of the floor and the wall.

Referring now to the drawings, and more particularly to FIGS. 1 and 4, a floor assembly 10 is shown positioned adjacent a vertical wall 12. The floor assembly 10 is the type typically found in, for example, a gymnasium, arena, school, or convention hall. The floor assembly 10 includes a rigid support base 14, a sub-flooring 16, a floor 18, and a baseboard 19. A cement slab is generally provided as the rigid support base 14 for the floor 18. The sub-flooring 16 is supported above the support base 14 in a spaced-apart relationship to define a floor gap 20. The sub-flooring 16 typically includes a first layer of plywood 22 and a second layer of plywood 24. The first layer of plywood 22 is often oriented in one direction while the second layer of plywood 24 is oriented in a second direction, which is often 45 degrees (not shown) or 90 degrees (FIG. 1) relative to the first direction. The floor 18 is constructed of a plurality of strips of material 26 positioned on the sub-flooring 16 and cooperating to form the floor 18. The strips of material 26 are typically manufactured from maple or other suitable wood. The floor 18 includes a peripheral edge 28 positioned proximate to the wall 12 to provide an expansion gap 30 at a floor-wall junction.

A plurality of spacers or shock absorbers 34 are illustrated supporting the sub-flooring 16 in a spaced apart relation regarding the base 14. The shock absorbers 34 are connected to the bottom surface of the first layer of plywood 22 at an equal center-to-center distance. For example, U.S. Pat. No. 6,742,312, which is expressly incorporated herein by reference, discloses a type of shock absorber 34 used in conjunction with the inventive concepts of disclosed herein.

However, it will be appreciated that any configuration of spacer or shock absorber may support the sub-flooring 16.

The baseboard 19 is illustrated positioned over at least a portion of the floor 18 and the wall 12 to cover the expansion gap 30 while providing sufficient air-flow (represented by arrows 36*a* and 36*b*) to and from the floor gap 20 to prevent the accumulation of moisture on the underside of the floor 18.

Figure 2:
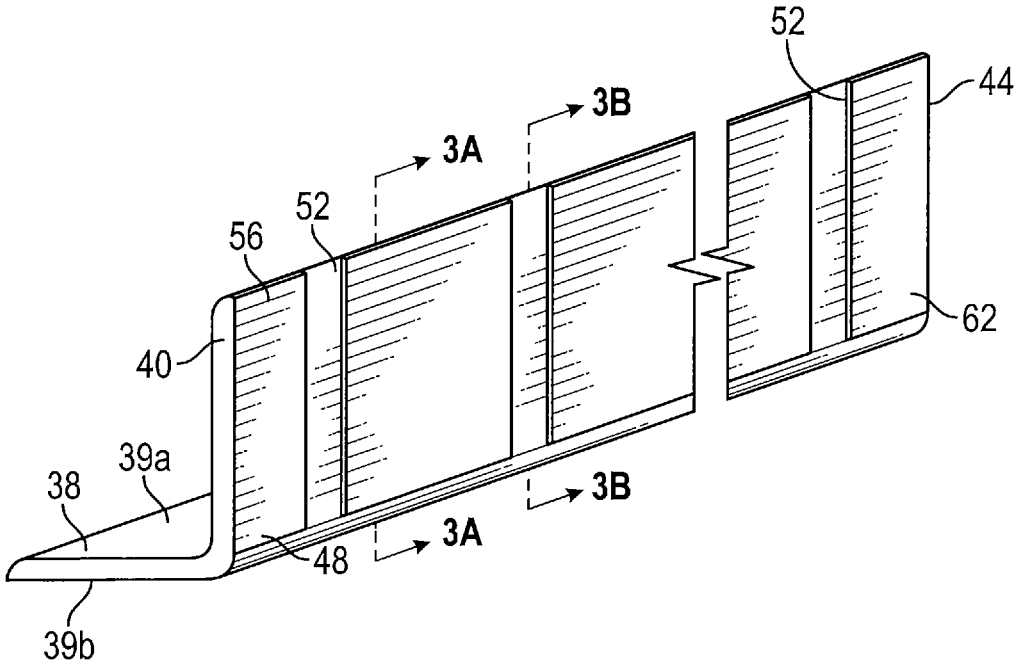
FIG. 2 is a rear, perspective view of the baseboard.
Figure 3A:
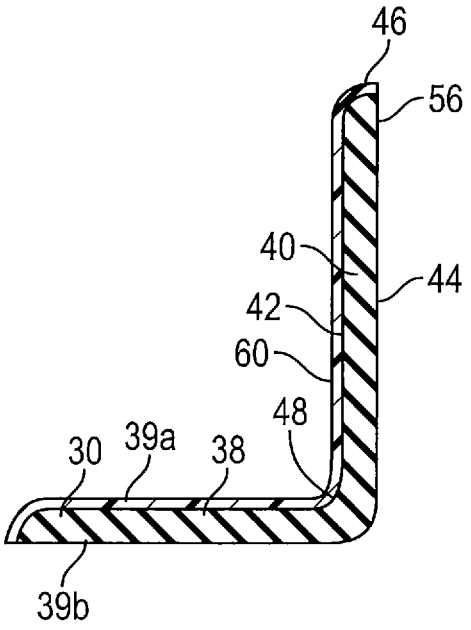
FIG. 3A is a cross-sectional view taken along line 3A-3A of FIG. 2.
Figure 3B:
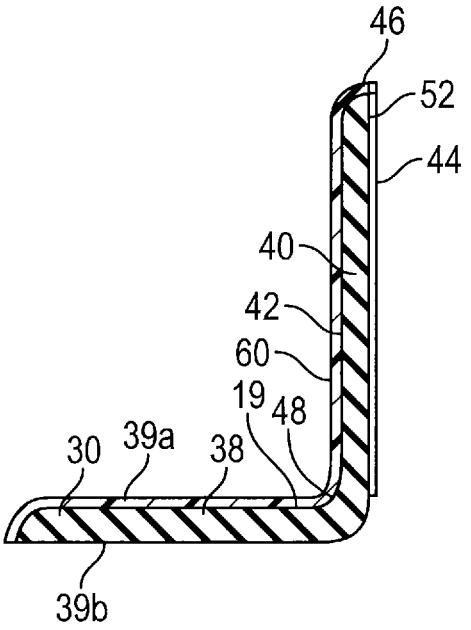
FIG. 3B is a cross-sectional view taken along line 3B-3B of FIG. 2.

Referring to FIGS. 2-4, the baseboard 19 is a substantially L-shaped body characterized as having a toe portion 38 and a wall portion 40. The toe portion has a front side 39*a* and a back side 39*b*. The wall portion 40 includes a front side 42, a back side 44, an upper end 46, and a lower end 48. The toe portion 38 may intersect the wall portion 40 at a substantially square edge, rounded edge, or any other edge configuration allowing the baseboard 19 to cover the expansion gap 30. The toe portion 38 is positioned adjacent the floor 18 and the wall portion 40 is positioned adjacent the wall 14.

Shown in FIGS. 2 and 4, the back side 44 of the wall portion 40 includes a plurality of spaced-apart, ventilation channels 52 extending from the upper end 46 of the wall portion 40 to the lower end 48 thereof to permit air-flow to and from the floor gap 20. However, it will be appreciated that each ventilation channel 52 may be positioned at a variety of directions including diagonally if air may flow to and from the floor gap 20. Each ventilation channel 52 may have a substantially rectangular cross-section. For example, each ventilation channel 52 may have a width of ½ inch and a depth of ⅛ inch. In addition, a sufficient number of ventilation channels 52 are formed so the wall portion 40 has a flow area of at least about 0.20 square inches per linear foot when the wall portion 40 is secured to the wall 12, but more preferably, a flow area of at least about 0.25 square inches per linear foot when the wall portion 40 is secured to the wall 12. For example, the baseboard 19 may have sixteen ventilation channels 52 per four feet of length.

A wall contact surface 56 extends between each ventilation channel 52 for engaging the wall 12 upon applying a suitable adhesive to the wall contact surfaces 56. Each wall contact surface 56 is substantially rectangular in shape.

The baseboard 19 is formed using conventional manufacturing processes, such as, injection molding and is preferably constructed of thermoplastic elastomer injected with a foaming agent to provide a durable, lightweight baseboard having a tear strength of approximately 800 pounds per square inch and a weight of approximately 0.83 pounds per linear foot, whereby a case of 16 baseboards of the present invention weighs less than about 55 pounds reducing shipping costs and potential injuries resulting from lifting and/or moving cases of baseboards. The baseboard 19 desirably has a hardness of at least 70, Shore A durometer.

During manufacturing, the material may be heated within a temperature range of about 340° F. to about 360° F., and preferably heated to a temperature of about 350° F. causing flow lines (not shown) to be created throughout the baseboard 19. The flow lines may provide a marbled appearance.

To cover the flow lines and provide a smooth, uniform appearance, at least the front side 39*a* of the toe portion 38 and the front side 42 of the wall portion 40 is coated with a flexible coating 60. In one embodiment, the flexible coating 60 is a single uniform color (e.g., black). The coating 60 may comprise a flexible, acrylic urethane resin paint, such as commercially available from CPS Coatings of Shreveport, La. under model no. 4000 Series. The coating 60 may include an effective amount of a plastisizer to increase the elasticity of the coating.

To apply the coating 60, the baseboard 19 is cleaned to remove dirt and grease. The baseboard 19 is then coated. Applying the coating 60 to the baseboard 19 may be conducted according to known application methods, such as the spray coating, electrostatic spraying, brush coating, dip coating, melt coating, flow coating or the like. When coating the baseboard 19 with a spray, the distance between the application device, for example an air spray gun (not shown), and the baseboard 19 should remain a uniform distance apart. In one embodiment, the application device may be supported in a stationary position and the baseboard 19 moved past the application device while the application device is dispersing the coating 60 to the baseboard 19. The uniform application allows the baseboard 19 to be coated quickly, efficiently, and uniformly. To provide adequate coverage of the baseboard 19 while maintaining flexibility of the coating 60, the coating 60 is applied to the baseboard 19 so the coating has a thickness in a range of about 1 mm to about 3 mm. When using an air spray gun for applying the coating 60, an enclosed or a semi-enclosed spray booth may keep the atmosphere dust-free, trap overspray, and allow for the venting of fumes.

To achieve a coated baseboard aesthetically appealing and mar-resistant and/or mar-masking durable, a pencil hardness test may be administered to the coated baseboard. The Pencil Hardness Test, also called the Wolff Wilborn test, measures the "pencil hardness" of the dry coating. The Pencil Hardness Test uses the varying hardness values of graphite pencils to evaluate the scratch hardness of the coating 60. The pencil is moved scratching over the surface under a 45° angle with constant pressure. An optical assessment is carried out to see which pencil hardness will damage the surface. The coating 60 has pencil hardness of at least 4H.

From the above description, it is clear that the inventive concepts disclosed and claimed herein are well adapted to carry out the objects and to attain the advantages mentioned herein, and those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and as defined in the appended claims.

What is claimed is:

1. A baseboard for covering an expansion gap at an intersection of a vertical wall and a floor, the baseboard comprising:

a substantially L-shaped body formed of a thermoplastic material and having a toe portion and a wall portion, the toe portion having a front side and a back side, the wall portion having a front side, a back side, an upper end, and a lower end, the back side of the wall portion provided with a plurality of spaced-apart ventilation channels extending entirely across the wall portion from the upper end of the wall portion to the lower end thereof to permit air-flow to and from the floor gap, wherein at least the front side of the toe portion and the front side of the wall portion coated with a flexible coating, wherein the coating is a flexible, acrylic urethane resin paint, and wherein coating has a thickness in a range of about 1 mm to about 3 mm.

2. The baseboard of claim 1, wherein the coating is a single, uniform color.

3. The baseboard of claim 1, wherein the coating has a pencil hardness of at least 4H.

4. The baseboard of claim 1, wherein the coating comprises a plasticizer.

5. A floor assembly in combination with a vertical wall, the floor assembly comprising:

a rigid support base;

a sub-flooring supported above the support base in a spaced-apart relationship to define a floor gap;

a plurality of strips of material positioned on the sub-flooring and cooperating to form a floor, the floor having a peripheral edge positioned proximate to the wall to provide an expansion gap; and a substantially L-shaped baseboard formed of a thermoplastic material and having a toe portion and a wall portion, the wall portion adhesively secured to the wall with at least a portion of the toe portion extending over a portion of the floor so the baseboard covers the expansion gap, the toe portion having a front side and a back side, the wall portion having a front side, a back side, an upper end, and a lower end, the back side of the wall portion provided with a plurality of spaced-apart ventilation channels extending entirely across the wall portion from the upper end of the wall portion to the lower end thereof to permit air-flow to and from the floor gap, wherein at least the front side of the toe portion and the front side of the wall portion coated with a flexible coating, wherein the coating is a flexible, acrylic urethane resin paint, and wherein the coating has a thickness in a range of about 1 mm to about 3 mm.

6. The combination of claim 5, wherein the coating is a single, uniform color.

7. The combination of claim 5, wherein the coating has a pencil hardness of at least 4H.

8. The baseboard of claim 5, wherein the coating comprises a plasticizer.

* * * * *